US005316173A

United States Patent [19]

Emery

[11] Patent Number: 5,316,173

[45] Date of Patent: May 31, 1994

[54] CARRY OUT TRAY

[76] Inventor: Roy W. Emery, 1 Donino Court, Toronto, Ontario, Canada, M4N 2H6

[21] Appl. No.: 97,679

[22] Filed: Jul. 27, 1993

[51] Int. Cl.[5] ..... B65D 1/36

[52] U.S. Cl. ..... 220/556; 220/507; 220/738; 220/575; 229/1.5 H; 229/2.5 R; 229/904; 206/564

[58] Field of Search ..... 220/507, 509, 516, 517, 220/518, 556, 575, 737, 738; 229/1.5 H, 904, DIG. 7, 2.5 R; 206/557, 564

[56] References Cited

U.S. PATENT DOCUMENTS

| | | | |
|---|---|---|---|
| 3,140,035 | 7/1964 | Wenzel | 229/904 X |
| 3,499,595 | 3/1970 | Brooks | 229/904 X |
| 3,638,849 | 2/1972 | Goings | 229/904 X |
| 3,915,371 | 10/1975 | Crabtree | 229/904 X |
| 4,208,006 | 6/1980 | Bixler et al. | 229/2.5 R |
| 4,218,008 | 8/1980 | Veilleux | 229/2.5 R |
| 4,278,197 | 7/1981 | Scheinbaum | 229/904 X |
| 5,094,343 | 3/1992 | Brown et al. | 206/216 |
| 5,096,065 | 3/1992 | Vigue | 206/564 |

*Primary Examiner*—Allan N. Shoap
*Assistant Examiner*—Stephen Cronin
*Attorney, Agent, or Firm*—Marshall, O'Toole, Gerstein, Murray & Borun

[57] ABSTRACT

Known trays for carrying beverage cups have three or four pressure panels spaced apart around the perimeter of each cell in a manner to hold the cup upright. In the tray of this invention each cell has only two opposing pressure panels, each directed downwardly and inwardly toward the central area of the cell, and each panel having two projections on its inwardly directed face appropriately spaced apart to provide four pressure contacts around the perimeter of the contained article. The pairs of pressure contacts are thus displaced outwardly in diametrically opposite directions by the contained article, so that round, oval or rectangular shapes can be contacted by each of the four pressure contacts.

10 Claims, 4 Drawing Sheets

CARRY OUT TRAY

1. FIELD OF THE INVENTION

This invention relates to carry out trays. In particular, it relates to carry out trays having at least one cell for receiving an article therein.

2. BRIEF DESCRIPTION OF THE PRIOR ART

Carry out trays are often provided with at least one cell in which to support a beverage cup in an upright position on the tray while it is carried by the consumer from the serving counter to the location where the beverage is to be consumed. Both the tray and the cup are generally intended for a one time use, and discarded thereafter. The smaller trays are often carried out while supported between the thumb and fingers of one hand.

One known design for such a tray has a cell with four independent flexible pressure panels spaced equally around the perimeter of the cell, and located to provide four pressure contact areas to the sides of a cup circular in cross section at the level at which the pressures are applied, in order thus to stabilize the cup in an upright position. The pressure panels are sloped downwardly toward the base of the cell, and inwardly towards its centre, and are resiliently displaced outwardly of the center of the cell when an article is placed between them. Thus articles of various sizes within a specific range can be received within such a cell, and supported in an upright position therein.

Another known type of carry out tray has a cell or cells in each of which a pair of pressure panels is positioned at each of three positions around its perimeter, and pressure is exerted by the pressure panels on the sides of the contained article at each of these three positions. A suitable degree of lateral stability is thus provided to the article contained in the cell.

3. SUMMARY OF THE INVENTION

It is the object of this invention to simplify the design of the cell, and make it more economical to manufacture, at the same time providing additional versatility in the classes and shapes of articles which can be accommodated within each cell. In principle, this simplicity and versatility, and at the same time economy in manufacture, is achieved by supporting the article in each cell between only two pressure panels, instead of between three or more such panels, as employed in other carry out tray designs. One method of achieving the stabilizing effect of four pressure contact areas for each article is by the incorporation of two parallel ribs on each panel, the ribs being of sufficient depth, and close enough together, to keep the contained article clear of the main body of the panel, and each pressure panel, together with its two ribs, being of sufficient vertical curvature and dimensions to supply adequate stabilizing pressure to any one of the entire range of shapes and sizes of articles intended to be accommodated in the cell. Other types of protuberances or irregularities in the surfaces of the pressure panels may be used to achieve the same stabilizing effect.

It should be noted that, while the present known types of carry out trays have the stabilizing cells designed specifically with the pressure panels spaced around to accommodate an article which is circular in cross-section at the level of the contact areas, the two pressure panels of the present invention, spaced directly opposite and parallel to each other within each cell, can accommodate a variety of cups, bottles, bowls or boxes which may be circular or oval or rectangular at the pressure contact level, provided they are in the size range of the articles for which the cell is designed.

According to one aspect of the invention there is provided a tray comprising at least one cell, said at least one cell having a supporting base adapted to receive an article thereon, said at least one cell comprising two opposing pressure panels extending downwardly towards said base, each of said pressure panels having inwardly directed faces and being inclined downwardly toward the centre of said at least one cell, and adapted to exert a restraining pressure on opposite sides of an article seated between them on said supporting base, each of said pressure panels having first and second projections protruding from their inwardly directed faces, said first and second projections being spaced laterally from each other in such manner as to exert restraining pressure in four locations spaced horizontally around the perimeter of said article, and thus to inhibit lateral movement of an article in said at least one cell.

4. BRIEF DESCRIPTION OF THE DRAWINGS

The following is a description by way of example of embodiments of the present invention, reference being made to the accompanying drawings in which.

5. DESCRIPTION OF PREFERRED EMBODIMENTS

Figure 1:
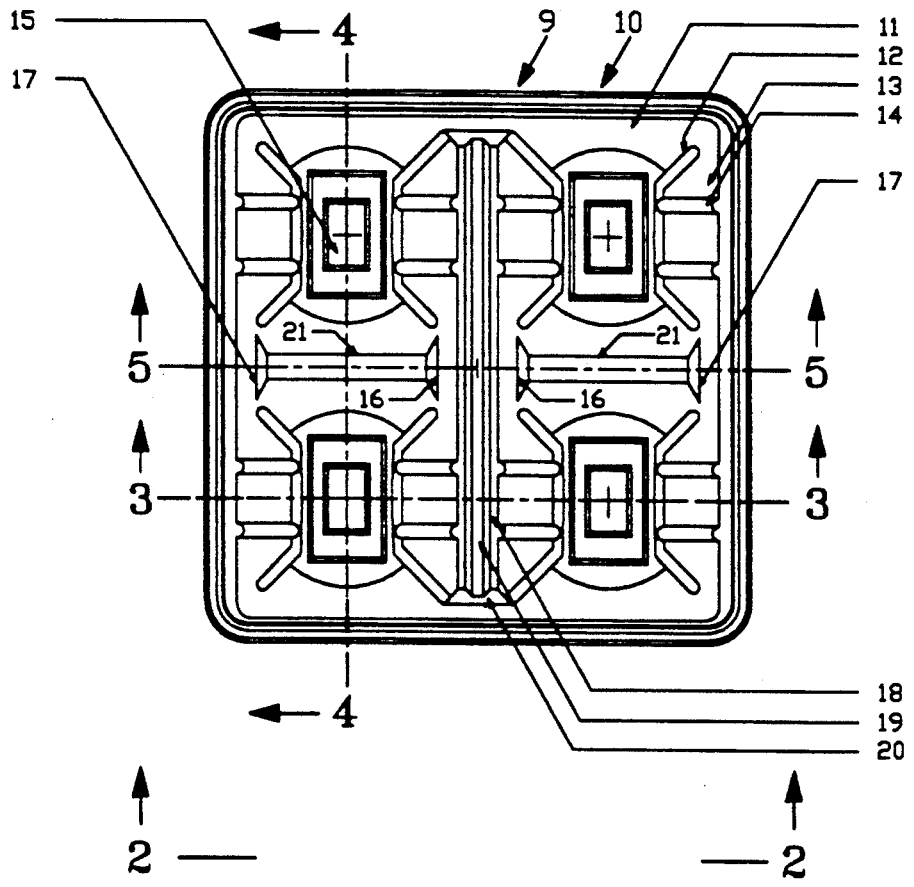
FIG. 1 is plan view of one embodiment of a tray.

With reference to FIGS. 1 to 5 a tray designated generally as 9 has four cells 10, each of which is supported by two supporting panels 11 extending down to an individual base 15, the supporting panels 11 being separated from the pressure panels 13 by the slots 12, each pressure panel 13 having two ribs 14. Side panels 11 are curved outwardly of the cell at the lower ends where they join the base 15. This permits an article having a curved surface to be accommodated and also provides for increased rigidity of the tray. A typical cup 23 is shown in phantom in FIG. 3, seated upon a base 15 and standing between two pressure panels 13 which, in use, would be deflected outwardly of the cell, with each of the four ribs 14, two on each panel 13, pressing upon the sides of the cup in order to stabilize it in an upright position. A supporting structure for the entire assembly of four cells 10 is formed between the surrounding frame by the main supporting bar 18 and the two cross bars 21. The bar 18 is supported at a low level at line 20 at each end, in order to provide for a continuous connecting wall section between the two panels 11 at each end of the bar. The two bars 21 have similar deep connections at each end at lines 16 and 17 which provide similar continuous connecting walls between adjacent pairs of pressure panels 13. The bar 18 has a continuous deep strengthening groove 19 along its entire length.

Figure 2:
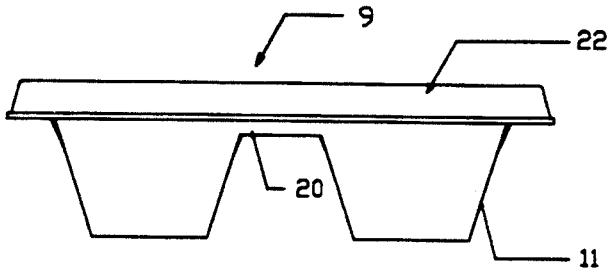
FIG. 2 is a side elevational view along the line 2—2 of FIG. 1.
Figure 3:
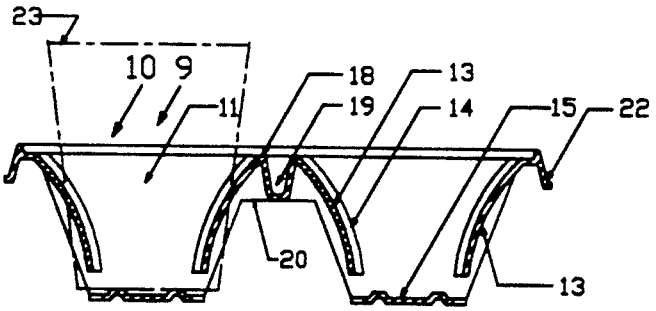
FIG. 3 is a cross-sectional view along the line 3—3 of FIG. 1.
Figure 4:
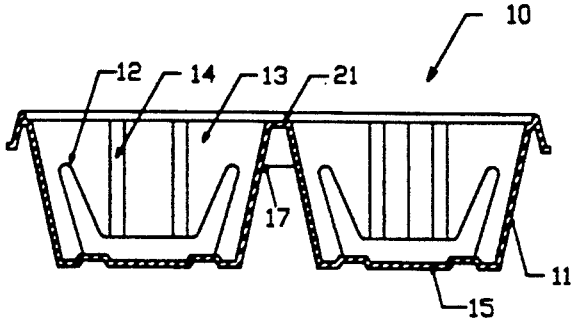
FIG. 4 is a cross-sectional view along the line 4—4 of FIG. 1.
Figure 5:
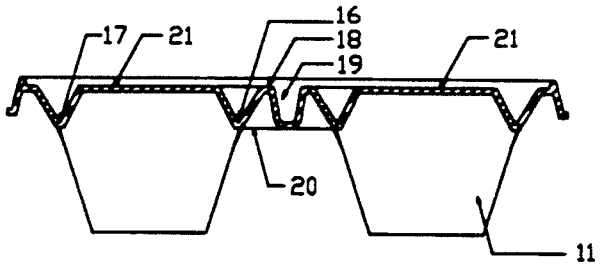
FIG. 5 is a cross-sectional view along the line 5—5 of FIG. 1.

In FIG. 2 the side elevational view of the carry out tray 9 shows the two support panels 11 connected together above line 20. Also shown is the flange 22 which forms a rigid supporting frame around the perimeter of the tray. In FIG. 4 are shown slots 12, which separate and free the pressure panels from the support panels 11. In the final design of a carry out tray the slots 12 may be adjusted in height at their upper ends, in relation to the thickness and stiffness of the intended material of the tray, in order to provide the appropriate resilience and restraint to apply the required pressure for each of the articles within the size range intended to be supported between the related opposing pair of pressure panels 13. All the elements of the tray are typically formed integrally with one another and may be made from recycled paper products.

Figure 6:
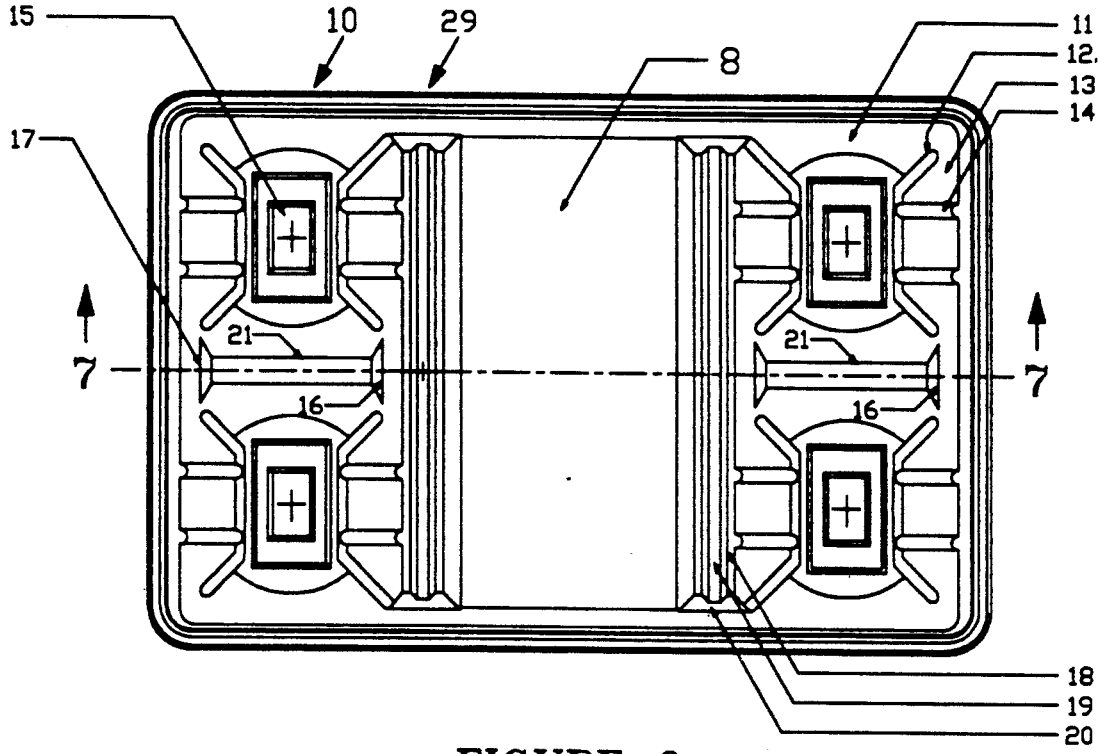
FIG. 6 is a plan view of an another embodiment of a tray.
Figure 7:
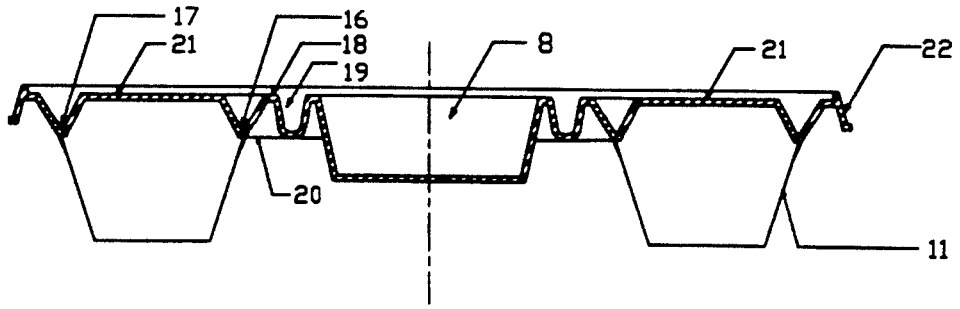
FIG. 7 is a side-elevation view along the line 7—7 of FIG. 6.

With reference to FIGS. 6 and 7, a tray generally designated as 29 has four cells 10 and an intermediate shallow pan 8 to contain sandwiches or other like material. The entire tray is supported at rest on the four bases 15, one in each cell 10, and these bases are connected to the main carrying frame by eight supporting panels 11, two in each cell 10, the main frame being comprised of the surrounding flange 22, connected with the two main supporting bars 18, and the two intermediate supporting bars 21.

It will be appreciated that the cells described above can be modified to better accommodate articles having other than circular surfaces, for example oval or rectangular shaped articles. Various other modifications are possible, of course, within the scope of the invention.

I claim:

1. A tray comprising at least one cell, said at least one cell having a supporting base for receiving an article thereon, said at least one cell comprising two opposing pressure panels extending downwardly toward said base, each of said pressure panels having inwardly directed faces and being inclined downwardly toward the centre of said at least one cell, and exerting a restraining pressure on opposite sides of any said article seated between them on said supporting base, each of said pressure panels having first and second projections protruding from their inwardly directed faces, said first and second projections being spaced laterally from each other in such manner as to exert restraining pressure in four locations spaced horizontally around the perimeter of said article, and thus to inhibit lateral movement of any said article in said at least one cell.

2. A tray as claimed in claim 1, wherein said tray further comprises a main carrying frame and wherein said at least one cell further comprises two supporting side panels, said supporting side panels extending generally downward between said main carrying frame and said supporting base and being positioned generally opposite each other and spaced alternately with said pressure panels around the perimeter of said at least one cell and arranged to receive said article therebetween.

3. A tray as claimed in claim 2, wherein said side panels are curved outwardly of said at least one cell at their lower ends where they having a curved surface, and at the same time to provide greater lateral stability to the structure of the tray.

4. A tray as claimed in claim 3, wherein slots are provided between said pressure panels and said supporting side panels, to permit said pressure panels to be independently displaced relative to said side panels.

5. A tray as claimed in claim 1, wherein said first and second projections comprise first and second ribs respectively, said ribs extending downwardly along the inner surfaces of said inwardly and downwardly inclined first and second pressure panels.

6. A tray as claimed in claim 5, wherein said pressure panels and said ribs are curved convexly inward in such manner that said ribs can abut articles of different sizes that may be received between them.

7. A tray as claimed in claim 2, wherein said at least one cell comprises first, second, third and fourth cells, said cells being arranged such that:

Said pressure panel of said first cell is aligned and adjacent to said pressure panel of said second cell;

Said pressure panel of said third cell is aligned and adjacent to said pressure panel of said fourth cell;

Said supporting side panel of said first cell is aligned and adjacent to said supporting side panel of said third cell;

Said supporting side panel of said second cell is aligned and parallel with and adjacent to said supporting side panel of said fourth cell.

8. A tray as claimed in claim 7, wherein said tray is integrally formed, comprising a structural flange surrounding a grouping of the first, second, third and fourth cells, and an internal connecting system of supporting bars together forming said main carrying frame, each pair of supporting side panels and each pair of pressure panels of each of the first, second, third and fourth cells being formed integrally therewith, the entire assembly being supported through the supporting side panels of each cell by the integrally formed supporting bases thereof.

9. A tray as claimed in claim 8, comprising an integrally formed space for receiving sandwiches and the like, said space being supported within the main carrying frame and located centrally between said four pairs of cells.

10. A tray as claimed in claim 9, wherein said tray is formed from recycled paper products.

* * * * *

UNITED STATES PATENT AND TRADEMARK OFFICE

CERTIFICATE OF CORRECTION

PATENT NO. : 5,316,173

DATED : May 31, 1994

INVENTOR(S) : Roy W. Emery

It is certified that error appears in the above-indentified patent and that said Letters Patent is hereby corrected as shown below:

Column 3, line 41, delete ",";

Column 4, line 7, after "where they" insert --join said supporting base, in order to accommodate any said article;

Column 4, line 51, delete "pairs";

Column 4, line 52, delete "of".

Signed and Sealed this

Eighth Day of November, 1994

Bruce Lehman

*Attest:*

BRUCE LEHMAN

*Attesting Officer*

*Commissioner of Patents and Trademarks*